United States Patent [19]

Driessen et al.

[11] 4,400,953

[45] Aug. 30, 1983

[54] APPARATUS FOR THE CONTINUOUS TREATMENT OF TEXTILE AND SIMILAR WEBS OF MATERIAL

[75] Inventors: Manfred Driessen, Krefeld; Walter Keller, Willich; Johannes Kutz, Tönisvorst, all of Fed. Rep. of Germany

[73] Assignee: Eduard Küsters, Krefeld, Fed. Rep. of Germany

[21] Appl. No.: 369,609

[22] Filed: Apr. 19, 1982

Related U.S. Application Data

[63] Continuation of Ser. No. 133,394, Mar. 24, 1980, abandoned.

[30] Foreign Application Priority Data

Sep. 1, 1979 [DE] Fed. Rep. of Germany ..... 2935413

[51] Int. Cl.³ ..... D06B 1/14

[52] U.S. Cl. ..... 68/202; 118/261

[58] Field of Search ..... 68/22 B, 43, 200, 202; 118/204, 205, 246, 258, 259, 261, 262; 8/477; 100/162 B; 29/113 R, 113 AD

[56] References Cited

U.S. PATENT DOCUMENTS

| | | | |
|---|---|---|---|
| 530,831 | 12/1894 | Florin-Leclercq | 68/202 X |
| 2,729,192 | 1/1956 | Warner | 118/262 X |
| 2,754,796 | 7/1956 | Faulkner, Jr. et al. | 118/204 X |
| 2,970,564 | 2/1961 | Warner | 118/261 X |
| 3,050,829 | 8/1962 | Appenzeller | 29/113 AD |
| 3,543,366 | 12/1970 | Collet | 100/162 B X |
| 3,701,269 | 10/1972 | Wilcox | 68/202 X |
| 4,118,526 | 10/1978 | Gregorian et al. | 101/170 X |
| 4,193,762 | 3/1980 | Namboodri | 68/200 X |

FOREIGN PATENT DOCUMENTS

| | | | |
|---|---|---|---|
| 2416259 | 10/1975 | Fed. Rep. of Germany | 68/200 |
| 280570 | 11/1928 | United Kingdom | 68/202 |

*Primary Examiner*—Philip R. Coe

*Attorney, Agent, or Firm*—Kenyon & Kenyon

[57] ABSTRACT

In the continuous treatment of webs of material with a treatment medium to be applied to the web of material, especially for dying, wherein foam containing the treatment medium is applied to the web material and is subsequently worked into the web of material, the foam is applied to the circumference of a revolving cylinder, by wiping it off to a defined layer height and the web of material caused to run freely onto the cylinder and the web is looped around the cylinder freely through a given angle.

13 Claims, 4 Drawing Figures

APPARATUS FOR THE CONTINUOUS TREATMENT OF TEXTILE AND SIMILAR WEBS OF MATERIAL

This is a continuation of application Ser. No. 133,394 filed Mar. 24, 1980, and now abandoned.

BACKGROUND OF THE INVENTION

This invention relates to the continuous treatment of textile and similar webs of material in general and more particularly to an improved method and apparatus for applying a foam treatment medium to textile and similar webs.

A method for the continuous treatment of a web of material of textiles or paper, particularly a dyeing treatment, by applying foam is known from DE-OS 27 22 082. The foam is applied directly to the substrate by means of a nozzle. Although it may be possible to satisfactorily apply large amounts of liquids in the form of foam to a web of material in this manner, it is not suitable for particularly small amounts of liquid because, the unavoidable variations of the amount of liquid applied by the nozzle to a given point of the web of material and also the local variations in the absorptivity of the web of material for the liquid, can lead to considerable relative differences in the coverage of the web of material, which manifest themselves in distinctly visible differences in the depth of the color upon dyeing. Even a later wiping off or squeezing off, as is described in U.S. Pat. No. 2,719,806 for the preparation of coatings, cannot bring, according to experience, aequate uniformity of the application for the dyeing process.

From U.S. Pat. No. 2,795,207, a coating arrangement is known, in which two cylinders are disposed opposite and parallel to each other at the same height and at an adjustable spacing. The web of material runs over the one cylinder, through the gap between the cylinders and around the lower part of the second cylinder. In the upper corner between the two cylinders, a foam feeding arrangement is provided which delivers the foam into the gap between the two cylinders so that it lies, on the one hand, on the surface of the second cylinder and, on the other hand, on the side of the web facing the former. The foam is fed in approximately at the height of the point at which the web of material is transferred from the first cylinder to the second one. The foam layer remains between the web of material and the second cylinder and separates from the second drum again after having travelled through a loop angle of about 180° with the web.

This design is intended for the preparation of coatings of the web of material with foam rubber, where the coating is to be maintained as a layer having a thickness of its own. Slight variations in the feeding of the foam do not matter here because they are mechanically equalized by the subsequent revolution about the second cylinder. In an attempt to dye with this known design, however, the unavoidable local differences in foam feeding would manifest themselves in a different coverage of the web of material with dyeing liquid, which leads to a non-uniform depth of color. This is true particularly because the foam is applied directly to the web of material and is accepted by the latter immediately. A non-uniform amount of dyeing liquid once accepted by the web of material through capillary action between the fibers or even by an initial partial drawing up onto the fibers can no longer be equalized subsequently, contrary to the case of a coating of a type which can later be equalized mechanically and which is to remain standing as a layer but is not to penetrate into the web of material.

SUMMARY OF THE INVENTION

It is an object of the present invention to develop an improved apparatus of the kind described above in such a manner that an application as uniform as possible per unit area of the treatment medium contained in the foam is accomplished.

According to the present invention, this problem is solved by applying the foam to the circumference of a revolving cylinder, but wiping it off to a defined layer height; and then allowing the web of material to run freely onto the cylinder and looping the web around the cylinder freely through a given angle.

The essential aspect of the present invention is that the foam is applied to the cylinder circumference, i.e., on a geometrically clearly defined substrate, without coming into contact with the web of material immediately. The foam can be wiped off by the wiper blade so as to form a very uniform layer on the substrate and the first contact of the web with the foam takes place at this layer which has been freed of the randomness in the feeding of the foam. The wiping also has a mechanically homogenizing effect on the foam, inasmuch as the larger bubbles are compressed by the pressure under the wiper exerted on the foam, and the over all bubbles structure is equalized.

The web of material should freely run in and loop around the cylinder freely. This means that, in the region of the cylinder, no squeeze or guiding rolls are to engage the web of material. Nonuniformities could again occur at these rolls due to beads of liquid or different pressure. The web of material should rather absorb the layer, previously equalized on the cylinder, by itself, without any change in the uniform distribution prepared on the cylinder, by external engagement.

This has a particularly dramatic effect at the edges of the web, which are loaded very uniformly with the treatment medium using the present invention. In the case of squeeze of guide rolls, it was never possible to avoid different amounts of liquid, which can cause corresponding differences in the coloring of the edges, from being present at the squeeze or guide rolls between the inner area and the edge zone.

The applicability of the present invention is not limited to the application of particularly small amounts of the treatment medium. However, in cases where particularly small amounts are to be applied, the conditions are particularly critical since small differences, seen absolutely, of the application per area unit already lead to considerable relative differences. For small applied amounts, the advantages of the present invention come to the fore most favorably. This is true particularly if the foam is then still full of voids.

The apparatus of the present invention includes a revolving cylinder, the length of which corresponds at least to the width of the web of material, means for directing the material onto the circumference of the cylinder at an entry point and looping the material over the cylinder through a loop angle, and foam feeding means for transferring foam, in a transfer zone, over the length of the cylinder directly against the circumference of the cylinder. In accordance with the present invention, a wiper is disposed parallel to the cylinder axis following the transfer zone and spaced from the circumference of the cylinder to form a foam layer of predetermined thickness on the cylinder, the wiper being followed in the direction of rotation by the entry point, and the means for directing including, as the last guide of the web of material before reaching said entry point, a guide roll the circumference of which is spaced from the circumference of the cylinder a distance which exceeds the total thickness of the foam layer and the web of material.

Preferably, the wiper is disposed at the lower opening of the foam feeding arrangement. It is essential that the chamber of the foam feeding arrangement be open toward the bottom, so that no dead corners are formed in which the foam dwells for extended periods of time and possibly collapses there, reverting to liquid. The foam is rather immediately transported on by this arrangement in the course of being fed in and is equalized at the exit from the chamber by the wiper.

By using a wiper with a convex surface when passing the wiper, the foam is, so to speak, driven into a wedge shaped gap and is compressed. This not only leads to a levelling of the foam surface but also homogenizes the foam.

Especially for small applied amounts, the adjustability of the wiper is essential. The distance of the wiper from the cylinder circumference is in the order of about one millimeter or even less. The foam is taken along by the revolving cylinder and drawn under the wiper, and then springs back to a larger layer thickness behind the wiper. Distance differences of a few tenths of a millimeter already cause considerable relative differences in the specific amounts of treatment medium applied in a width range of the web.

To maintain such a small distance with a precision of one-tenth of a millimeter or less over the width of the web of material of several meters, precise setting devices are required.

An embodiment of the wiper for controlling the bending using a concentric tube about a shaft which is controlled by a fluid pressure is also disclosed. It is noted that hydraulically or pneumatically supported wipers of a similar nature in rotary screen printing are described in German Offlegungsschrift 21 10 492.

A specific mechanical design of the foam-feeding arrangement is one including a plate directed toward the cylinder at an angle with a sealing lip resting on the top side of the wiper. Also disclosed is the practical embodiment of a dual arrangement, by means of which a web of material can be provided with treatment medium by means of a foam application from two sides, and means for applying a pattern to the web.

The present invention is suitable for textile webs as well as for similar webs of material such as nonwoven fabrics, warps, paper and also bundles of threads, e.g., bundles of threads running parallel to each other at intervals. Thus, as used, herein, "web of material" encompasses all these possibilities.

DETAILED DESCRIPTION OF THE INVENTION

Figure 1:
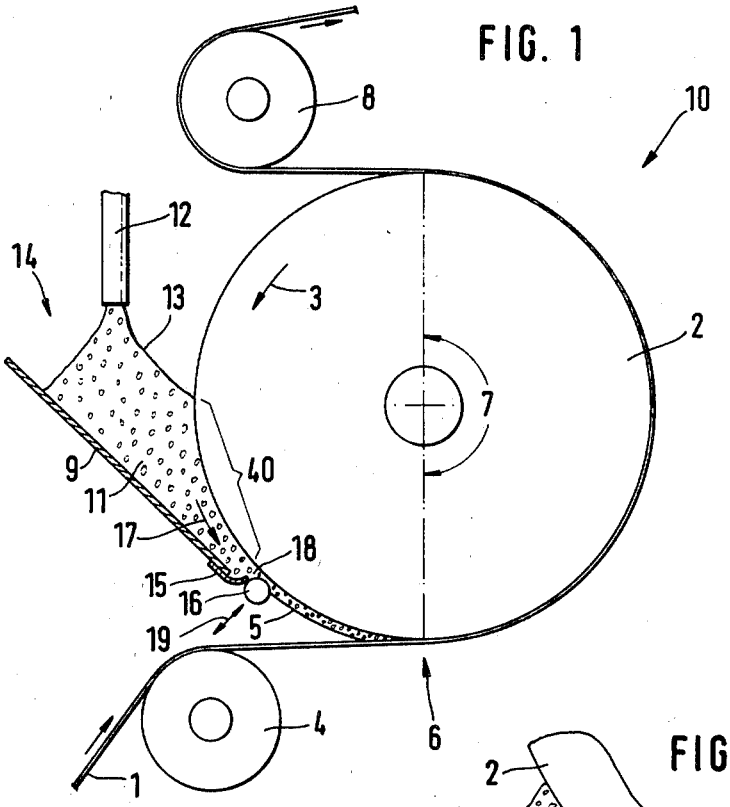
FIG. 1 is a schematic diagram illustrating the principle of the invention.

The apparatus of FIG. 1 designated generally as 10 comprises a cylinder 2 with a smooth, closed surface, which extends over the width of the web of material and rotates in the direction of the arrow 3. The web of material 1 runs in the direction indicated over a guide roll 4, which is spaced a distance greater than the thickness of the foam layer 5 and the web of material 1 from the circumference of the cylinder 2. The web 1 runs onto the cylinder 2 at a point 6, is looped around the cylinder 2 over a loop angle 7, which in the illustrated embodiment is about 180°, and is then conducted away via a further guide roll 8. In accordance with the present invention loop angles of 120° to 240° are preferred.

On the side which is descending when the cylinder 2 rotates, i.e., on the left according to FIG. 1, a chamber 11 into which foam 13 is fed via a foam feeding tube 12 and which extends over the length of the cylinder 2, is formed by a plate 9 which is directed toward the cylinder 2 at an angle, i.e., approaches the lower part of the cylinder 2. The elements constitute the foam feeding arrangement 14. At the lower edge of the plate 9, a lip 15 which rests against the top side of a wiper 16 which is designed as a tube is disposed. The wiper 16 extends parallel to the axis of the cylinder 2 a small distance from the circumference of the latter. The construction of the wiper 16 will be described in detail by reference to FIG. 2.

The foam 13 placed into the chamber 11 is carried along by the rotation of the cylinder 2 in the direction of the arrow 3 into the transfer zone 40 in accordance with arrow 17 and, after passing the lower opening 18 of the chamber, is conducted between the cylinder 2 and the wiper 16, and subsequently forms a levelled and homogenized foam layer 5 on the cylinder 2. It is essential that the chamber 11 of funnel-shaped cross section be open toward the bottom and have no undercuts, so that there are no dead corners in which foam could stay for extended periods and might possibly collapse. The entire quantity of foam is immediately transported onward in the course of its being fed in and is pulled through, out of the lower opening 18 of the chamber 11, and under the wiper 16.

Figure 2:
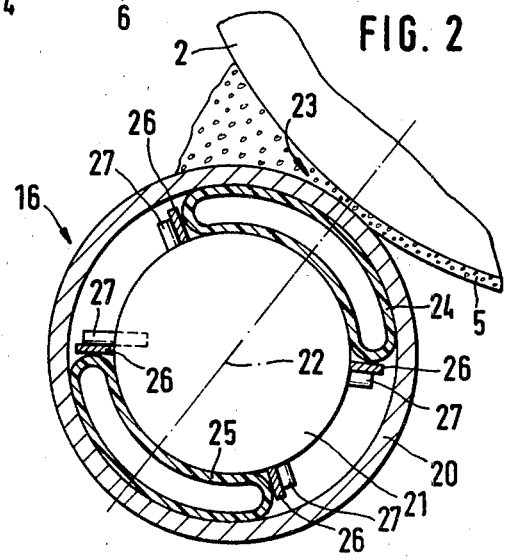
FIG. 2 is an enlarged cross section through the wiper of the apparatus of the present invention.

According to FIG. 2, the wiper 16 includes an outer non-rotating tube 20 which extends along the cylinder 2. Tube 20 is supported on a stationary core 21 extending on its inside, by means of bearings at the ends. Otherwise an annular space remains between the core 21 and the tube 20. Core 21 consists of bar stock and is supported a fixed manner at its ends protruding from the tube 20 but is adjustably relative to the cylinder 2 in the radial direction according to the arrow 19 (FIG. 1).

In the setting, i.e., adjusting, plane represented by the line 22, flattened hoses 24 and 25 are arranged on the side of the gap 23 between the cylinder 2 and the wiper 16 as well as on the opposite side; they extend substantially over the length of the tube 20, are closed at their ends and can be filled with a pressure fluid in a controlled manner. The tubes 24, 25 are held in their position by strips 26 which are supported on the core 21 by pins 27.

The pressure occurring in the gap 23, causes a bending moment to be exerted on the tube 20; as a result, the tube 20 is removed somewhat from the surface of the cylinder 2 in the middle, which makes the gap 23 and the amount of foam transferred to the cylinder 2 nonuniform. To counteract this deflection, a pressure which acts against the bending of the tube 20 from the inside, is generated in the hose 24, the hose 24 being braced against the core 21, which can be deflected in turn under the action of the pressure toward the left and the bottom according to FIG. 2, without this deflection being transmitted to the tube 20. The pressure in the hose 25 is naturally set correspondingly small or is made zero altogether. It is, of course, also possible to pursue the opposite intent and to make the gap 23 intentionally nonuniform by prebending the tube 20 by a particularly high pressure in the hose 24 against the cylinder 2, or, with preponderant pressure in the hose 25, by pulling it away from the cylinder 2 particularly much in the middle.

The foam 13 is transferred from the opening 18 into the gap 23 which is geometrically exactly defined. The cylinder 2 represents a precise substrate for the foam, which must pass through the accurately defined narrowest point of the gap 23 and is wiped off in the process to a desired uniform thickness, and is furthermore at the same time homogenized by the compression when entering into the funnel shaped gap 23. The homogenized layer 5 is carried away by the cylinder 2. Only after a certain angular distance does the web 1 run onto cylinder 2 at the point 6 when the cylinder 2 rotates in the direction of the arrow 3. Only after the homogenized layer 5 is produced, does the web of material 1 therefore come into contact with the foam 13.

The tension of the web 1 need be only large enough to ensure proper guidance thereof in the range of the loop angle 7. It depends to a certain extent also on the individual case, since different materials can have different running properties. The apparatus is especially suitable for applying small amounts of treatment medium. With these quantities, the web of material is not to be impregnated in the proper sense, but instead the treatment medium is to remain in the proximity of the surface. Therefore, the normal contact pressure required to merely guide the web is generally sufficient because in such a case it is not necessary to push in the foam for thoroughly impregnating the web.

With such a machine it has been possible to dye white cotton material on one side completely uniformly with a pink shade of color without a trace of penetration on the backside. A foam with a high foam number was used, i.e., one with a high volume ratio between the foam and the liquid making it, for instance, in the range of 15 to 20. Typically foam can be applied in the amount of 5 to 18 grams per square meter of web.

Figure 3:
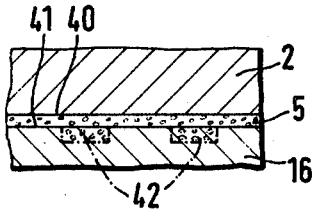
FIG. 3 is a vertical section through apparatus for dying on both sides by the application of foam.

FIG. 3 shows a fraction of a cross section parallel to the setting plane at the narrowest point between the cylinder 2 and the wiper 16. Two embodiments of the wiper 16 are indicated. In the first embodiment, a straight generatrix line 41 of the wiper 16 is just opposite the straight generatrix line 40 of the cylinder 2 at the narrowest point of the gap 23. In that case, a constant thickness of the foam layer 5 is obtained over the length of the gap 23, which makes uniform dyeing possible. However, the generatrix "line" 41 can also be profiled in the form of recesses or cutouts 42, whereby the foam layer 5 is no longer flat but is given a complementary profile which leads to a corresponding stripe pattern on the web of material 1. Here, too, the invention is essential because it ensures that the profiling is also uniform and in particular, that portions of the generatrix "line" left standing between the cutouts 42 always have the same distance from the cylinder 2.

If the wiper 16 comprises an outer tube 20 in the manner shown in FIG. 2, the cutouts, 42 are milled or cut from the tube 20. However, it is also entirely possible to use a blade like or leaf like wiper of conventional design, the cutouts 42 would then appear as cutouts in the wiper edge.

Figure 4:
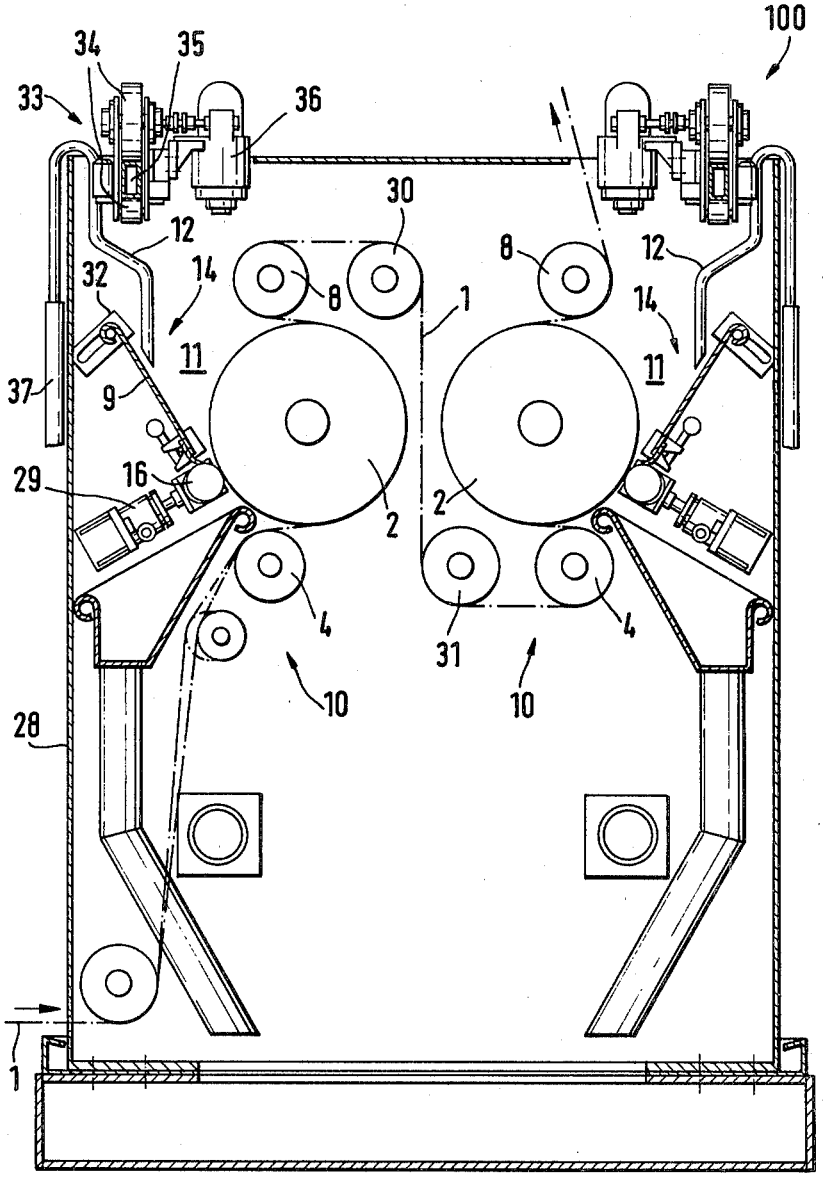
FIG. 4 is a cross section along the setting plane of the wiper.

In FIG. 4, a practical design, designated generally as 100, is depicted in which two of the arrangements 10 shown in FIG. 1, are disposed in such a manner that they sequentially provide both sides of the web 1 with a foam application.

The two cylinders 2 of the devices 10 are disposed parallel to each other approximately at the same height with a space between them. The web of material 1 enters the housing 28 of the machine 100 from below is then conducted upward over the guide roll 4 which, according to FIG. 4, is located under the left cylinder 2, is looped around the left-hand cylinder 2 and the guide roll 8 thereabove as well as over a guide roll 30 which is disposed at about the same height, whereupon the web 1 is conducted between the cylinders 2, without making contact, over a guide roll 31 and another guide roll 4 located under the right cylinder 2, over the right cylinder 2 and the guide roll 8 located thereabove, and is pulled off there.

The respective foam feeding arrangements 14 are disposed at the outsides. The wipers 16 are set against the cylinder 2 by means of a spindle drive 29. The angle of the plate 9 can be adjusted at a guide 32. The foam feeding tubes 12 are fastened to a slide 33 which can be moved back and forth in a controlled manner by means of a motor 36 on a track extending across the web. The foam is fed in via flexible lines 37. In this manner, the foam is distributed uniformly in the chambers 11.

What is claimed is:

1. Apparatus for the continuous treatment of webs of materials comprising:

(a) a revolving cylinder, the length of which corresponds at least to the width of the web of material;

(b) means for directing the web of material onto the circumference of said cylinder at an entry point and freely looping said material around said cylinder through a loop angle;

(c) foam feeding means for transferring foam, in a transfer zone, over the length of the cylinder, directly against the circumference of the cylinder;

(d) a wiper disposed parallel to the cylinder axis following said transfer zone and spaced from the circumference of said cylinder to form a foam layer of predetermined thickness on said cylinder, said wiper being followed in the direction of rotation by said entry point; and (e) said mean for directing including, as the last guide of the web of material before reaching said entry point, a guide roll, the circumference of which is spaced from the circumference of said cylinder a distance which exceeds the total thickness of the foam layer and the web of material.

2. Apparatus according to claim 1, in which said foam feeding means includes a chamber with a lower opening through which the foam emerges toward the circumference of said cylinder, and wherein said wiper is disposed at said lower opening.

3. Apparatus according to claim 2, wherein said wiper comprises a cylindrical body with a convex surface.

4. Apparatus according to claim 1 and further including an adjusting device for adjusting the radial distance of said wiper from the circumference of the cylinder.

5. Apparatus according to claim 1 and further including a device for adjusting the radial distance of the wiper from the circumference of the cylinder differently over the length of the wiper.

6. Apparatus according to claim 5 wherein said wiper comprises: an outer tube; a core extending lengthwise through said tube, leaving a distance from the inside circumference of the tube; and, in a plane intersecting the axis of said core and the axis of said rotating cylinder, on the side of said wiper adjacent said rotating cylinder, between said core and the inside of said tube, a chamber with walls resilient in said plane, which extends substantially over the length of said tube and can be filled with a pressure medium.

7. Apparatus according to claim 6, and further including on the side opposite said rotating cylinder, in said plane, between the core and the inside circumference of the tube, a chamber with walls resilient in a direction toward said rotating cylinder, which extends substantially over the length of the tube and can be filled separately with a pressure medium.

8. Apparatus according to claim 7, wherein at least one of said chambers is formed by a hose which is closed except for a supply line for the pressure medium.

9. Apparatus according to claim 1 wherein said foam feeding means comprises a plate which is directed toward the descending side of the circumference of the cylinder at an angle having a sealing lip resting with its lower edge on the top side of the wiper.

10. Apparatus according to claim 1 wherein said wiper is disposed in the lower quadrant of the descending side of said cylinder when it rotates, and said entry point is disposed approximately at the lowest point of the cylinder.

11. Apparatus according claim 1 wherein said loop angle is 120° to 240°.

12. Apparatus according claim 1 comprising first and second of said cylinders arranged at the same height, each having one of said foam feeding arrangements on its outer side, and guide roll arrangements above and below each of said cylinders respectively said web of material being conducted over the guide roll arrangement disposed below said first cylinder, around said first cylinder from below, over the guide roll arrangement disposed above said first cylinder, downward between said cylinders without making contact, from below over the guide roll arrangement disposed under said second cylinder, around said second cylinder and, from below, over the guide roll arrangement disposed above said second cylinder.

13. Apparatus according to claim 1 wherein said wiper has a profile.

* * * * *